United States Patent [19]

Lehmann et al.

[11] 4,116,128

[45] Sep. 26, 1978

[54] DEVICE FOR CONTROLLING A WASHING LIQUID LEVEL IN A WASH TANK OF A PRINTING MACHINE

[75] Inventors: Werner Lehmann, Gutach; Horst Purr, Tennenbronn; Herrmann Raible, St. Georgen, all of Germany

[73] Assignee: Mathias Bäuerle GmbH, Germany

[21] Appl. No.: 796,187

[22] Filed: May 12, 1977

[30] Foreign Application Priority Data

May 14, 1976 [DE] Fed. Rep. of Germany ..... 2621804

[51] Int. Cl.[2] ..... B41F 35/00

[52] U.S. Cl. ..... 101/425; 15/256.52; 101/364; 101/367; 222/56; 222/67

[58] Field of Search ..... 15/256.52; 222/56, 67; 101/363, 364, 367, 425

[56] References Cited

U.S. PATENT DOCUMENTS

| | | | |
|---|---|---|---|
| 1,690,888 | 11/1928 | Dawe | 101/364 |
| 2,472,389 | 6/1949 | Von Stoeser | 222/67 |
| 2,511,921 | 6/1950 | Keuper | 101/425 |
| 2,667,990 | 2/1954 | Mojonnier | 222/67 |
| 2,704,029 | 3/1955 | George | 101/425 |
| 2,775,257 | 12/1956 | Stirn et al. | 101/350 |
| 3,373,052 | 3/1968 | Rode | 101/363 |
| 3,408,053 | 10/1968 | Vantroba | 222/67 |
| 3,630,148 | 12/1971 | Schinke et al. | 101/425 |
| 3,667,500 | 6/1972 | Stone | 101/364 |
| 3,942,526 | 3/1976 | Wilder et al. | 222/67 |

*Primary Examiner*—William Pieprz
*Attorney, Agent, or Firm*—McGlew and Tuttle

[57] ABSTRACT

A device for controlling and monitoring the level of a washing liquid in a washing unit of a printing machine which includes a wash tank having a washing liquid therein and a pickup roller mounted in the tank and rotatable in the washing liquid to lift the liquid on the surface of the roller and transfer it to a rubber blanket roller to be cleaned, comprises a control tank which is connected to the wash tank and arranged at substantially the same level as the control tank. A supply tank for the washing liquid is located above the control tank and supplies liquid into the control tank under the regulation of an electromagnetically controlled valve. The valve is switched in order to provide for flow from the supply tank into the control tank in accordance with the level in the control tank. The level of the control tank therefore maintains a level in the wash tank by virtue of the flow between the control tank to the wash tank. In order that the control can be effected precisely, the control tank is provided with a partition wall having a control size opening therethrough below water level so that water which is delivered from the supply tank into one side of the partition wall will flow to an opposite control side only gradually so as to regulate a float valve which is connected in a circuit to operate the control valve from the supply tank to the control tank.

4 Claims, 1 Drawing Figure

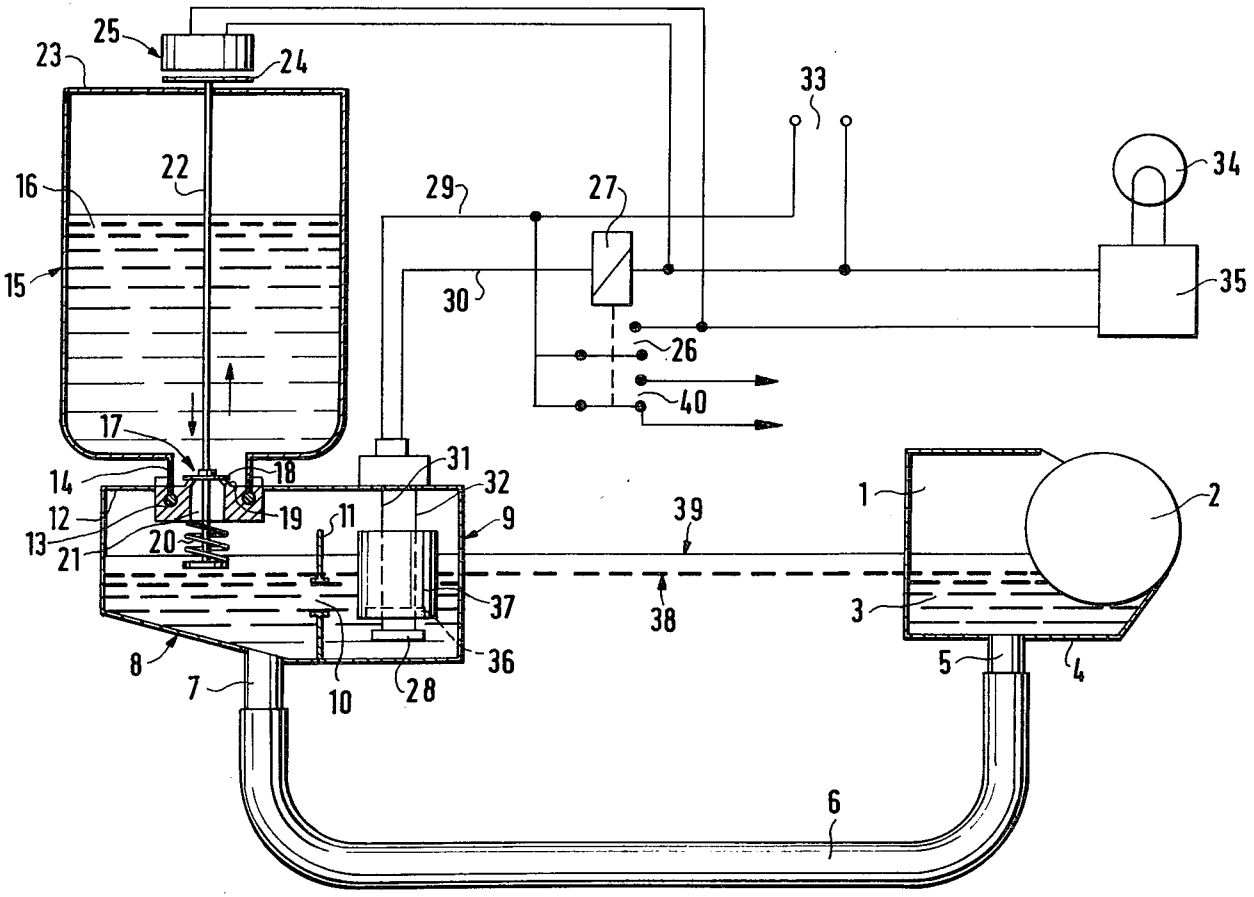
34
35
2
4
5
1
3
6
33
26
40
39
38
27
29
30
32
9
37
36
31
28
11
10
24
18
19
22
20
7
25
17
8
23
16
15
14
12
13
21

DEVICE FOR CONTROLLING A WASHING LIQUID LEVEL IN A WASH TANK OF A PRINTING MACHINE

FIELD AND BACKGROUND OF THE INVENTION

This invention relates in general to cleaning devices for printing machines and, in particular, to a new and useful device for controlling and monitoring the level of a washing liquid in a washing unit of a printing machine.

DESCRIPTION OF THE PRIOR ART

The present invention relates to a device for controlling and monitoring the level of the washing liquid in the washing unit of an offset printing machine, particularly a small offset machine, comprising a pickup tank wherefrom the washing liquid is removed by means of a lifting or washing cylinder and transferred to the blanket roller.

In a known device of this kind, (German Utility Model No. 6,809,450), the washing liquid is received in a tub-shaped, pivotally mounted pickup tank which extends along the entire length of the rubber blanket roller to be cleaned from time to time, and which is refilled with the liquid through a funnel pipe, as needed. To make the level of the washing liquid in the pickup tank visible, the tank is connected through a flexible tube to a substantially tubular sight vessel which is disposed at approximately the same level. Since only a definite number of revolutions of the blanket roller is available for one washing cycle, the washing liquid in the pickup tank must be permanently kept at a certain level which cannot be permitted to vary significantly. This requires a frequent refilling with washing liquid. Aside from the inconvenience of attendance connected to such frequent refilling, this washing unit of the prior art involves the risk that often too much liquid will be filled into the tank, and because of the pivotal motion of the pickup tank executed at every start and end of the washing cycle, that liquid will be spilled or too much liquid will be transferred from the lifting or washing cylinder to the blanket roller to be cleaned.

In another known rubber blanket roller washing unit (German Auslegeschrift No. 1,111,216), the cleaning cylinder is disposed externally of the liquid level of the pickup tank. The tank has the shape of a tub, and a wick is placed therein which is in contact with the surface of the cleaning cylinder and thus conveys the cleaning liquid to this surface. Such an arrangement makes it unnecessary to move the washing liquid containing tank when the cleaning cylinder is brought in contact with the blanket roller to be cleaned. However, the metered quantities of the washing liquid conveyed in each cycle to the surface of the cleaning cylinder vary considerably, so that satisfactorily uniform washing operations are not ensured. In addition, a change of the wick effect with the time is to be taken into account, which again results in a less efficient washing action.

SUMMARY OF THE INVENTION

The present invention is directed to a device for automatically controlling the level of the washing liquid in the pickup tank in a manner such that the quantity of liquid removed by a lifting or washing cylinder dipping into washing liquid contained in the tank remains at least approximately constant, ensuring satisfactorily uniform washing operations, and preventing a removal of an excess amount of washing liquid or a spilling of the liquid.

To this end, in accordance with the invention, the pickup tank is connected to a control tank by communicating tubes which is disposed substantially at the same level and which is connected to a supply tank by means of an electromagnetically actuable valve which is controllable by a float switch provided in the control tank.

Aside from the automatic control of the level of the washing liquid in the pickup tank, the main advantage obtained with the invention is that the washing liquid can be fed automatically from an associated supply tank in the required, exactly metered amounts, with the effect of not only increasing the operational security and improving the quality of cleaning, but also considerably facilitating the attendance required.

Accordingly, it is an object of the invention to provide a device for controlling and monitoring the level of a washing liquid in a washing unit of a printing machine, which unit includes a roller rotatable in the washing liquid to lift up the liquid and transfer it to a rubber blanket roller which is to be cleaned and which includes a connection from the wash tank to a control tank which is arranged at substantially the same level as the wash tank and which further includes means for supplying additional liquid to the control tank in accordance with the level of the liquid in the control tank so as to provide a regulation of the liquid level in the control tank and, hence, a regulation of the liquid level in the wash tank through a connection from the control tank to the wash tank.

A further object of the invention is to provide a device for controlling and monitoring the level of washing liquid in a washing unit of a printing machine which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

BRIEF DESCRIPTION OF THE DRAWING

The only FIGURE of the drawing is a schematic sectional view of a device for controlling and monitoring the level of a washing liquid in a washing unit of a small offset press of a printing machine, constructed in accordance with the invention.

DESCRIPTION OF THE PREFERRED EMBODIMENT

Referring to the drawing in particular, the invention embodied therein, comprises a device for controlling and monitoring the level of a washing liquid in a washing unit of a printing machine, particularly a small offset press, which includes a pickup or wash tank 1 which extends along the entire length of a blanket roller to be cleaned (not shown), and in which a washing cylinder or pickup roller 2 is mounted so as to be partially immersed in a washing liquid 3. In a bottom 4 of the pickup tank 1, there is a pipe connection 5, to which a flexible tube 6 is connected. This positioning of pipe 5 insured that it is always below the liquid levels 39 or 38 in the tank 1. The other end of flexible tube 6 is slipped on a pipe connection 7 which is secured in the bottom 8 of a closed control tank 9. the volumetric capacity of control tank 9 is substantially smaller than that of pickup tank 1, since the purpose of tank 9 is only to control the level in tank 1. For this reason, tank 9 is fixed at approximately the same level as pickup tank 1 and is connected thereto by the flexible tube 6, in the manner of a communicating tube.

Control tank 9 is designed with a partition wall 11 which is provided at a location below the level of the washing liquid with a passage aperture or opening 10, the function of which will be explained hereinafter. At the side of partition wall 11 where pipe connection 7 is provided, a cover 12 of control tank 9 supports a connector or receiving part 13 for the neck 14 of a bottle-shaped supply tank 15 containing a supply 16 of washing liquid. Supply tank 15 may be of a disposable plastic bottle type which is commerically available. As shown in the drawing, supply tank 15 is mounted on control tank 9 in an upside-down position. Neck 14 of supply tank 15 is provided with an outlet valve 17 including portions comprising a valve disc 18 and a valve seat 19. Valve disc 18 is pressed into contact with valve seat 19 by the action of a compression spring 20 so that outlet valve 17 is kept closed. A rod 22 extends coaxially of outlet opening 21 of neck 14 and through the upwardly oriented bottom 23 of the supply tank 15. A valve disc 18 carried by rod 22 is connected to a disc-shaped armature 24 of an electromagnet 25. Electromagnet 25 is controlled by switch contacts 26 of a relay 27 in which, in turn, is actuated by a float switch in the form of a protective-tube contact switch 28 which is mounted in the control tank 9, near the bottom thereof, in a fixed or vertically adjustable position and is connected through lines 29, 30, 31 and 32, in the circuit of relay 27. Relay 27 is supplied from a low-voltage source 33 to which a signal lamp 34 is further connected, which is also switched by switch contact 26 of relay 27. A blinker unit 35 is series-connected to lamp 34, which makes the lamp blink as soon as there is no longer enough liquid supplied from supply tank 15 to keep the minimum level in control tank 9.

Protective-tube contact switch 28 which comprises a magnetically attractable movable member sealed within non-magnetic tube to isolate it from the washing liquid, is actuated by a permanent magnet 36 which is secured to a float 37 and moves up and down therewith in accordance with the varying liquid level in the control tank. As shown in the drawing, float 37, carrying permanent magnet 36 and protective-tube contact switch 28, are provided in control tank 9 at the side of the partition wall 11, which is opposite to the outlet and inlet of the tank, and the liquid present in the space where the float is provided is in contact with the liquid at the opposite side of partition wall 11 only through passage aperture 10. The cross-sectional area of aperture 10 is dimensioned so that while liquid flows into and out of control tank 9, the liquid level in the space where float 37 is provided varies always slower than in the other space at the other side of partition wall 11. Thereby, a certain delay in the switching of relay 27 or contact switch 28 by which electromagnet 25 is controlled, is obtained, with the further result that outlet valve 17 is opened at the minimum level 38 and closed at the maximum level 39.

It is also possible, of course, to have the contact switch 28 secured to float 37 and, instead, the permanent magnet 36 fixed to control tank 9. By providing a further contact switch 40 of relay 27, it is made possible to actuate, for example, an acoustic signal, in addition to signal lamp 34, and/or to stop other functions of the machine.

While a specific embodiment of the invention has been shown and described in detail to illustrate the application of the principles of the invention it will be understood that the invention may be embodied otherwise without departing from such principles.

What is claimed is:

1. A device for controlling and monitoring the level of washing liquid in a washing unit of a printing machine, which machine includes a wash tank having a washing liquid therein, a pickup roller mounted in the wash tank and rotatable in the washing liquid to lift the liquid therefrom and move it on the roller surface above the liquid level to transfer it to a rubber blanket roller to be cleaned, comprising a control tank adapted to be located alongside the wash tank at substantially the same level thereof and having a connection to the wash tank connected to the wash tank at a location below the level of the liquid in the wash tank, a supply tank for washing liquid located above said control tank, a supply conduit connection from said supply tank to said control tank, an electromagnetically actuable valve having a prtion in said supply conduit connection for regulating the flow through said conduit connection to said control tank, a float switch mounted on the liquid in said control tank and connected to said valve to open and close said valve so as to maintain the level of liquid in said control tank at a predetermined amount and thereby to regulate the level of liquid of said wash tank correspondingly by flow between said control tank and said wash tank through the connection therebetween, and a partition wall in said control tank having an opening therethrogh located below the level of liquid in said control tank, said float switch being located on one side of said partition wall to cause a time-delay in the action of said float switch and the other side of said partition wall being connected to said supply tank and said connection to the wash tank.

2. A device according to claim 1, wherein said supply tank comprises a bottle-like vessel having a neck portion, said tank being inverted above said control tank, said valve being partly located in said neck portion and comprising spring means biasing said valve to a closed position, said valve comprising an armature, and an electromagnet located alongside said armature for moving said valve.

3. A device according to claim 2, wherein said electromagnet is located outside of said bottle-like vessel, said valve including a rod-like member terminating in said armature at one end and having a valve portion in the neck of said vessel.

4. A device according to claim 1, wherein said float switch comprises a protective tube-contact switch located in said control tank and a float member having a permanent magnet thereon being movable to actuate said contact switch.

* * * * *